United States Patent [19]

Bauguion

[11] 4,263,471

[45] Apr. 21, 1981

[54] CABLE FOR DIGITAL TRANSMISSION

[75] Inventor: Laurent Bauguion, Chaponost, France

[73] Assignee: Les Cables de Lyon, Lyon, France

[21] Appl. No.: 109,374

[22] Filed: Jan. 3, 1980

[30] Foreign Application Priority Data

Jan. 3, 1979 [FR] France ..... 79 00075

[51] Int. Cl.[3] ..... H01B 11/04

[52] U.S. Cl. ..... 174/34

[58] Field of Search ..... 174/32, 34, 36, 27, 174/113 R

[56] References Cited

FOREIGN PATENT DOCUMENTS 2220957 4/1973 Fed. Rep. of Germany ..... 174/34

295592 2/1929 United Kingdom ..... 174/34

764056 12/1956 United Kingdom ..... 174/34

*Primary Examiner*—Laramie E. Askin

*Attorney, Agent, or Firm*—Sughrue, Rothwell, Mion, Zinn and Macpeak

[57] ABSTRACT

A cable for digital transmission, said cable (1) being constituted by a plurality of twisted quads (6) each of which has a particular pitch length (A . . . N), the quads being grouped together in one or several layers bundles (2,3,4 and 5) and four bundles being grouped together in the cable. With a view to reducing cross-talk, especially at the high frequencies used for digital transmission, it is recommended to use identical twist lengths only under certain conditions. This produces a simpler cable in which the circuits can be completely filled with digital signals. Application to PCM transmission.

5 Claims, 1 Drawing Figure

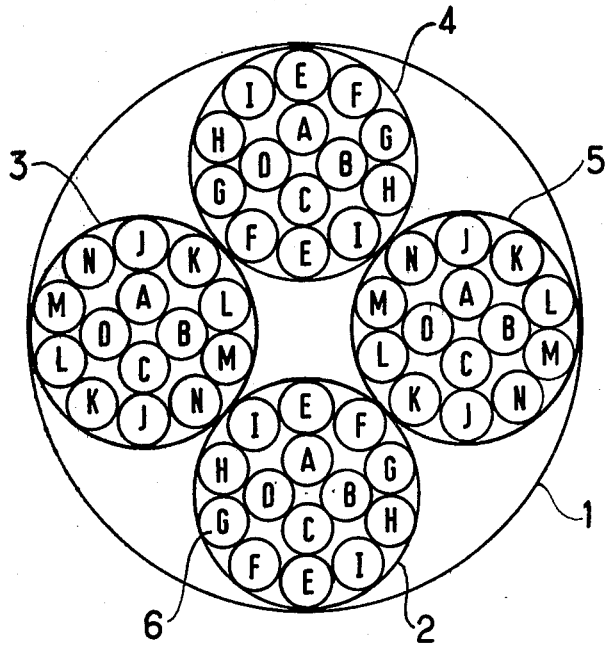
4
3
5
1
6
2
A
B
C
D
E
F
G
H
I
J
K
L
M
N

CABLE FOR DIGITAL TRANSMISSION

The present invention relates to a cable for digital transmission, said cable being constituted by a plurality of twisted quads each of which has a particular twist length, several quads being grouped together in one or more layers in a bundle and four bundles being grouped together in the cable.

Present network cables cannot be entirely filled with digital transmission systems because of excessive cross-talk. It is known that the level of cross-stalk depends in particular on the number of different twist lengths (lays) used for the quads in the cable. At present, six different twist lengths are used in a four-bundle cable having fourteen quads per bundle: four twist lengths for the four quads in each bundle centre and two alternating twist lengths for the ten-quad outer layer.

This is quite sufficient for low-frequency signal subscriber connections, i.e. for signals between 300 and 3400 Hz, in which magnetic coupling has less influence than capacitive coupling, due to the high characteristic channel impedance. However, this impedance which, for a given cable, is about 1000 Ohms at 800 Hz, decreases to 100 Ohms for frequencies higher than 200 kHz. Now, for digital transmission, the binary transmission rate is 2 Mb/s. This leads to the power load on the cable having a maximum at a frequency of 1 MHz.

Therefore, to reduce cross-talk, the number of twist lengths must be increased so as to reduce the number of quads having the same twist length and so as to place these quads as far apart as possible from one another. This is particularly important for circuits used for two-way transmission, since the near-end cross-talk specification is more difficult to comply with than the far-end cross-talk specification.

However, because of the cost price, it is necessary to limit strictly the number of different twist lengths in a cable. Preferred embodiments of the present invention reconcile the contradictory requirements of low cross-talk level at high frequencies and simple manufacture of the cable.

The present invention provides a cable for digital transmission, said cable being constituted by a plurality of twisted quads each of which has a particular twist length, a plurality of quads being grouped together to form a bundle having a central layer of quads surrounded by at least one further layer of quads and four bundles being grouped together to form the cable, wherein the, or each layer of quads surrounding the central layer of a bundle includes quads of identical twist length, arranged so that within any one layer there are at least two quads of different twist lengths between a pair of quads of identical twist length, wherein the bundles all have identical arrangements of twist lengths in their inner layer(s) of quads, the arrangements differing only for their outermost layers and wherein diametrically opposite pairs of bundles in the cable have identical arrangements of twist lengths.

By complying with these rules relating to which quads can be of identical twist length, a cable is obtained in which the cross-talk level is low and allows the cable to be completely occupied with digital data transmission.

An advantageous embodiment of the invention will be described in greater detail with reference to the accompanying drawing, in which the single FIGURE shows a transversal cross-section of a 112-circuit (i.e. 56-quad) circuit in which the quads are grouped together in four different bundles.

In accordance with the aforementioned embodiment, the cable 1 is divided into four bundles 2,3,4 and 5 each including fourteen quads such as 6. The FIGURE illustrates distinctly a central layer of four quads and a peripheral layer of ten quads. The letters inside each quad indicate particular twist lengths (lays), identical letters indicating identical twist lengths and different letters indicating different twist lengths for the quads in question. The central layer of each bundle is constituted by four quads of different twist lengths A, B, C and D. As for the peripheral layer, two types of bundle may be distinguished, with pairs of bundles of the same type occupying diametrically opposite places in the cable. In the first type of bundle, e.g. bundles 2 and 4, the peripheral layer includes two sets of five quads of different twist lengths E,F,G,H and I which are different from the corresponding twist lengths J,K,L,M and N of the other type of bundle. Therefore, the twist length of any one quad is never the same as that of the quads adjacent to it, nor the same as that of the quads which are separated from it by a single quad of different twist length. This result is obtained by judiciously distributing only fourteen different twist lengths. A smaller number of different lays can be provided by distributing the quads of the peripheral layer in groups of three or four quads instead of in groups of five quads. This leads to at least some twist lengths being used three times over in the peripheral layer of each bundle.

Further, in each bundle, three successive layers may be provided, with all the bundles being identical as far as concerns the distribution of the twist lengths in their central and intermediate layers, and the two different types of bundle being distinguished by the choice of twist lengths used in their peripheral layers.

The various twist lengths should not be distributed randomly in the cable, but rather they should be distributed judiciously so that they comply with the following rules:

1. The twist lengths of the peripheral layer of one type of diametrically opposite bundles in the cable are all less by at least 10% than the twist lengths of the periheral layer of the other type of diametrically opposite bundles.

2. The twist length of any one quad differs by at least 10% from that of the quads next to it in the same layer.

3. The twist lengths of two quads in the same layer and separated by one other quad differ by at least 2%.

4. The relative difference in twist length between two quads in two adjacent layers in the same bundle is at least equal to 3.5%.

By complying with these rules, distribution can be obtained as in the table hereinbelow:

| A | B | C | D | E | F | G | H | I | J | K | L | M | N |
|---|---|---|---|---|---|---|---|---|---|---|---|---|---|
| 100 | 110 | 90 | 120 | 104 | 139 | 126 | 115 | 130 | 94 | 76 | 85 | 74 | 83 |

The figures given in the table are relative values with respect to an average twist length, whose value is 100.

Of course, the invention is not limited to the embodiment described hereinabove in detail, especially as far as concerns the figures given for the twist lengths, the number of layers and the number of quads inside a layer.

Further, it is possible to envisage bundles of less than 14 quads and if the number of quads is sufficiently low, opposite bundles need not necessarily have identical twist lengths.

I claim:

1. A cable for digital transmission, said cable being constituted by a plurality of twisted quads each of which has a particular twist length, a plurality of quads being grouped together to form a bundle having a central layer of quads surrounded by at least one further layer of quads and four bundles being grouped together to form the cable, wherein the or each layer of quads surrounding the central layer of a bundle includes quads of identical twist length, arranged so that within any one layer there are at least two quads of different twist lengths between a pair of quads of identical twist length, wherein the bundles all have identical arrangements of twist lengths in their inner layer(s) of quads, the arrangements differing only for their outermost layers and wherein diametrically opposite pairs of bundles in the cable have identical arrangements of twist lengths.

2. A cable according to claim 1, wherein the twist lengths of the outermost layer of one pair of diametrically opposed bundles are all at least 10% shorter than the twist lengths of the outermost layer of the other pair of bundles.

3. A cable according to claim 1 or 2, wherein the twist length of any quad differs by at least 10% from the twist length of the quads next to it in the same layer.

4. A cable according to claim 1 or 2, wherein the twist lengths of two quads which are in the same layer and are separated by one other quad differ by at least 2% from each other.

5. A cable according to claim 1 or 2, wherein the difference between the twist lengths of two quads in two adjacent layers of the same bundle is at least equal to 3.5%.

* * * * *